US006491814B1

(12) United States Patent
Wheeler

(10) Patent No.: US 6,491,814 B1
(45) Date of Patent: Dec. 10, 2002

(54) SANI DRAIN

(76) Inventor: Leon I. Wheeler, 14426 N. 62nd Pl., Scottsdale, AZ (US) 85254

( * ) Notice: Subject to any disclaimer, the term of this patent is extended or adjusted under 35 U.S.C. 154(b) by 0 days.

(21) Appl. No.: 09/984,045

(22) Filed: Oct. 26, 2001

Related U.S. Application Data

(60) Provisional application No. 60/244,977, filed on Nov. 2, 2000.

(51) Int. Cl.[7] ..... E03C 1/264; E03C 1/266; B01D 29/03; B01D 35/02

(52) U.S. Cl. ..... 210/164; 210/203; 210/206; 210/209; 210/232; 210/474; 210/482; 4/652; 4/289; 4/292; 4/294

(58) Field of Search ..... 210/238, 201, 210/203, 209, 471, 474, 164, 232, 482, 206; 4/289, 292, 294, 652

(56) References Cited

U.S. PATENT DOCUMENTS

| | | | | |
|---|---|---|---|---|
| 852,044 | A | * | 4/1907 | Van Der Minden |
| 878,670 | A | | 2/1908 | Reynolds |
| 1,515,073 | A | * | 11/1924 | Savard |
| 1,935,128 | A | * | 11/1933 | Pullman |
| 2,087,592 | A | * | 7/1937 | Chesnut |
| 2,097,044 | A | * | 10/1937 | Riddle |
| 2,654,097 | A | * | 10/1953 | Epstein |
| 5,003,642 | A | * | 4/1991 | Robb et al. |
| 5,019,346 | A | * | 5/1991 | Richter et al. |
| 5,284,586 | A | | 2/1994 | DeSalvo |
| 5,297,299 | A | | 3/1994 | Wilson |
| 5,546,614 | A | * | 8/1996 | King, II |

* cited by examiner

*Primary Examiner*—Thomas M. Lithgow
(74) *Attorney, Agent, or Firm*—Patent & Trademark Services; Joseph H. McGlynn

(57) ABSTRACT

A tablet filter which can be attached to a standard grid covering that is attached to a drain like the kind found in homes, restaurants, factories and markets. The tablet filter will be suspended below the standard grid covering to trap any debris which is not trapped by the standard grid covering and, in addition, can be impregnated with various scents or sanitizing agents.

8 Claims, 1 Drawing Sheet

SANI DRAIN

Applicant claims priority for Provisional application Ser. No. 60/244,977, filed Nov. 2, 2000.

BACKGROUND OF THE INVENTION

This invention relates, in general, to a drain attachment, and, in particular, to a drain attachment which can be affixed to a standard drain.

DESCRIPTION OF THE PRIOR ART

In the prior art various types of drain attachments have been proposed. For example, U.S. Pat. No. 5,297,299 to Wilson discloses a device made from nylon thread mesh which can be attached to a drain to trap loose hair and/or other objects which can become lodged in a drain, thereby clogging the drain.

U.S. Pat. No. 5,284,586 to DeSalvo discloses a wire mesh filter screen shaped as a flat disk which will fit in a flat bottom counterbore to filter objects from becoming lodged in and clogging a drain.

U.S. Pat. No. 876,670 to Reynolds discloses a slip clip which can be used to attach one type of device to another.

SUMMARY OF THE INVENTION

The present invention is directed to a dissolving tablet filter which can be attached to a standard grid covering that is attached to a drain like the kind found in homes, restaurants, factories and markets. The tablet filter will be suspended below the standard grid covering to assist trapping any debris which is not trapped by the standard grid covering and, in addition, can be impregnated with various scents or sanitizing agents.

It is an object of the present invention to provide a new and improved drain sanitizer filter.

It is an object of the present invention to provide a new and improved drain sanitizer filter which can be attached to a standard drain covering.

It is an object of the present invention to provide a new and improved drain sanitizer filter which will assist trapping debris passed by a standard drain covering.

It is an object of the present invention to provide a new and improved drain sanitizer filter which can be treated with various scents to hide any unpleasant odors.

It is an object of the present invention to provide a new and improved drain filter which can be impregnated with sanitizing agents to prevent the build up of bacteria in a drain.

These and other objects and advantages of the present invention will be fully apparent from the following description, when taken in connection with the annexed drawings.

DESCRIPTION OF THE PREFERRED EMBODIMENT

Figure 1:
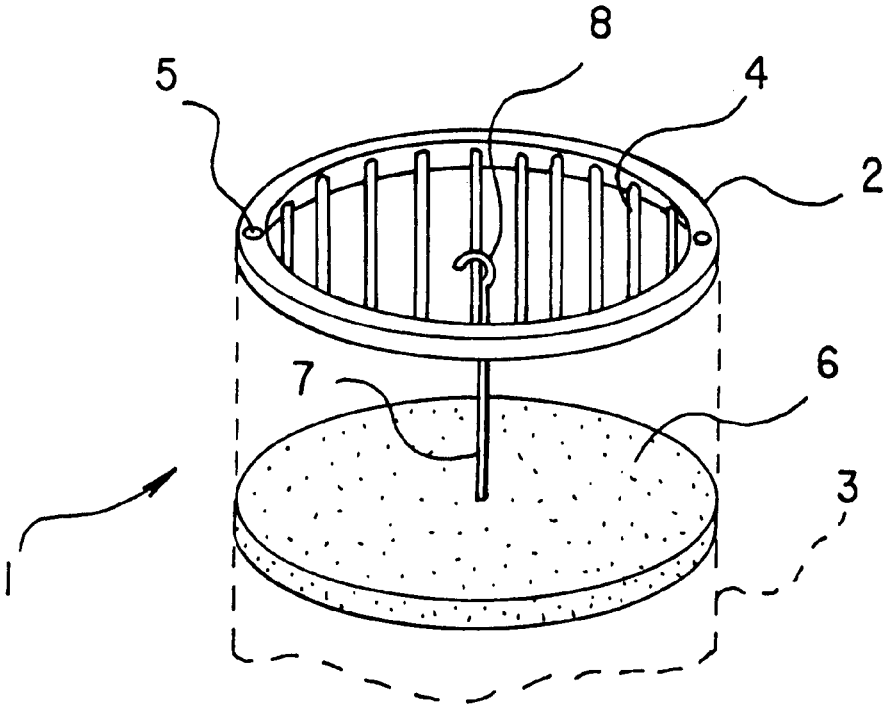
FIG. 1 is perspective view of the present invention attached to a standard drain cover.
Figure 2:
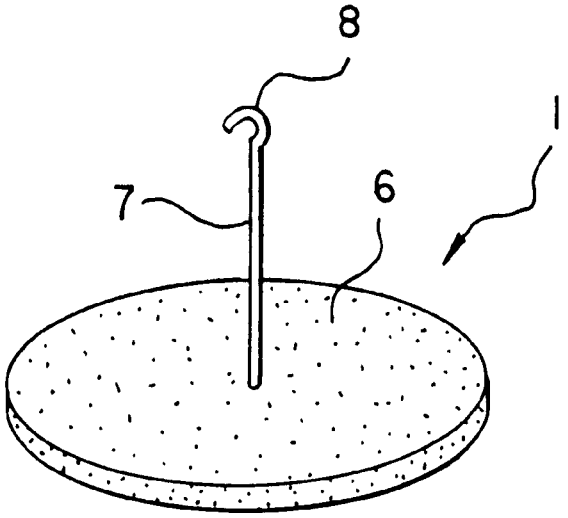
FIG. 2 is a perspective view of the present invention.

Referring now to the drawings in greater detail, FIG. 1 shows a perspective view of the present invention 1 as it is attached to a standard drain cover 2. As shown in FIG. 1, the standard drain cover 2 has a plurality of grid-like elements 4 which will fit over the top of a drain 3. The cover may have apertures 5 which will receive conventional screws (not shown) to attach the cover 2 to the drain 3. The purpose of the grid-like elements 4 is to trap and prevent any debris such as hair or other loose objects from passing into the drain 3 and blocking up the drain. If this occurs, water will be unable to pass through the drain. This sometimes requires the services of a professional plumber to unclog the drain resulting in a high bill to the homeowner or business owner.

While the standard drain cover 2 works to trap some objects, the spacing between the grid-like elements 4 can be large enough that some objects will still pass through, resulting in a clogged drain. In order to prevent this, the present invention is employed to cooperate with the standard drain cover in order to trap objects that might pass through the standard drain cover 2.

The present invention 1 comprises a disk shaped dissolving tablet filter 6 which will have approximately the same outside dimensions as the inside dimension of the drain 3. The tablet filter 6 will be made from a material that will pass water therethrough. Also, the tablet filter is not limited to any specific dimensions.

The filter will be suspended, as shown in FIG. 1, beneath the standard drain cover 2 by a hook. The stem 7 of the hook will be attached to the tablet filter 6 in any conventional manner. The upper portion of the hook will have a curved end 8 which will "hook" onto at least one of the grid-like elements 4. This hook will suspend the filter 6 directly below the standard cover 2. In this manner some debris that passes through the openings between the grid-like elements 4 will be trapped by the tablet filter 6. If the tablet filter 6 becomes so clogged with debris that water will not pass through the filter, all that is necessary to unclog the filter is to remover the standard cover 2 and the filter 6. Next the tablet filter will be unhooked from the cover 2 and the debris removed from the tablet filter. Then the tablet filter and cover will be replaced and the drain will operate in a normal manner. This will prevent the necessity of calling a professional plumber to unclog the drain 3.

Another problem associated with water drains is bacteria sometimes builds up in the drain pipe which results in unpleasant odors. In addition, the bacteria build up can result in a health hazard, especially if the drain is located in a food preparation area. The present invention will also alleviate this problem. The tablet filter 6 can be impregnated with a pleasant scent which will either mask or remove any unpleasant odors. In addition to, or in lieu of, the impregnated scent, the tablet filter 6 could be impregnated with a sanitizing agent such as, but not limited to, bleach which will eliminate, or at least lessen the amount of bacterial build up in the drain 3.

In order to use the present invention, a user merely has to remove the standard cover 2 from the drain. Next, the tablet filter is suspended beneath the drain cover 2 by means of the hook 7, 8, and then the cover 2 is replaced.

It should be noted that the tablet filter of the present invention has been disclosed as using a single hook 7, 8, which is attached to a single grid-like element 4. However, it should be understood that the hook does not have to engage a single grid-like element. It could engage a plurality of grid-like elements. Also, more than one hook could be used to suspend the filter 6 beneath the cover 2.

Although the sani drain and the method of using the same according to the present invention has been described in the foregoing specification with considerable details, it is to be understood that modifications may be made to the invention which do not exceed the scope of the appended claims and modified forms of the present invention done by others skilled in the art to which the invention pertains will be considered infringements of this invention when those modified forms fall within the claimed scope of this invention.

I claim:

1. A filter adapted to be attached to a drain cover, said drain cover having apertures to pass water through the drain cover, said filter comprising:

a body comprising a solid tablet, having a top surface, a bottom surface and sides connecting said top and bottom surfaces, said body comprised of a material that will pass liquids therethrough, said body having means for attaching said body to an underside of said drain cover.

2. The filter as claimed in claim 1, wherein said means for attaching said body to an underside of said drain cover is at least one hook.

3. The filter as claimed in claim 1, wherein said body is impregnated with a sanitizing agent.

4. The filter as claimed in claim 1, wherein said sanitizing agent is bleach.

5. A filter for a drain cover in combination with a drain cover, wherein said drain cover has a plurality of apertures to pass water through the drain cover, and said filter comprising:

a body comprising a solid tablet, having a top surface, a bottom surface and sides connecting said top and bottom surfaces, said body comprised of a material that will pass liquids therethrough, said body having means for attaching said body to an underside of said drain cover.

6. The filter as claimed in claim 5, wherein said means for attaching said body to an underside of said drain cover is at least one hook.

7. The filter as claimed in claim 6, wherein said plurality of apertures are formed by a plurality of bars separated by spaces, and said hook passes through said spaces and is attached to said bars.

8. The filter as claimed in claim 5, wherein said plurality of apertures are formed by a plurality of bars separated by spaces.

* * * * *